US005160134A

United States Patent [19]

McDonald

[11] Patent Number: 5,160,134

[45] Date of Patent: Nov. 3, 1992

[54] COMBINED GOLF GREEN REPAIR TOOL AND TIMEPIECE

[76] Inventor: Thomas L. McDonald, 35 Montana Trail, Prince Frederick, Md. 20678

[21] Appl. No.: 836,755

[22] Filed: Feb. 19, 1992

[51] Int. Cl.[5] ..... A63B 57/00; G04B 47/00

[52] U.S. Cl. ..... 273/32 B; 368/10; 248/114

[58] Field of Search ..... 273/32 B, 32 R, 32 A, 273/32 H; 224/903, 180; 248/114; 368/10

[56] References Cited

U.S. PATENT DOCUMENTS

| | | | |
|---|---|---|---|
| D. 253,420 | 11/1979 | Heerlien | D21/234 |
| D. 307,619 | 5/1990 | Koutroukides | D21/234 |
| D. 312,415 | 11/1990 | Muller et al. | D10/31 |
| D. 318,625 | 7/1991 | Stowell | D10/31 |
| 2,718,749 | 9/1955 | Florman | 368/10 |
| 3,622,157 | 11/1971 | Hatch | 273/32 B |
| 4,960,239 | 10/1990 | Wait | 273/32 B |
| 4,960,278 | 10/1990 | Hainey | 273/32 B |
| 5,022,650 | 7/1991 | Madock | 273/32 A |
| 5,025,426 | 6/1991 | Blumberg et al. | 368/10 |

*Primary Examiner*—George J. Marlo
*Attorney, Agent, or Firm*—Richard C. Litman

[57] ABSTRACT

A combination tool for use in the game of golf includes both a green repair tool and watch or timepiece. The back of the timepiece is secured to the central portion of the tool, and the timepiece may be removed from the back for battery replacement or other work. Preferably, the timepiece is a wristwatch which includes insets in each side of the case for clearance for the ends of a wristband. The central portion of the tool provides holes underlying these insets for a keychain and ball marker retention. Thus, a golfer may leave other bulky articles such as keys, wallet, wristwatch, etc. behind in a clubhouse locker while out on the course, retaining only the tool of the present invention with a locker key. The tool may be carried easily in a pocket, where the golfer will have ready access to the tool to check the time as desired, mark a ball on the green, and/or use the tool for the minor repair of depressions in the green.

6 Claims, 1 Drawing Sheet

COMBINED GOLF GREEN REPAIR TOOL AND TIMEPIECE

FIELD OF THE INVENTION

This invention relates generally to tools and accessories used in the game of golf, and more specifically to a tool for the repair of depressions in the surface of a golf green in combination with a watch or timepiece.

BACKGROUND OF THE INVENTION

As is well known, the game of golf involves the striking of a ball in order to cause it to travel toward a hole on a golf green. At distances far removed from the hole, the ball is generally struck relatively forcefully, and will generally travel an arcuate path through the air before hitting the ground at the end of its flight. The particular spot where the ball hits the earth may be damaged or depressed to a certain extent, due to the impact of the ball. This is particularly true of golf greens, where the surface is exceptionally smooth and well manicured in order to provide the greatest accuracy for putting the ball on the final approach to the hole.

As noted above, much of the play of the game deals with the striking of the ball with a great deal of force in order to provide a relatively long distance of travel for those strokes which are some distance from the hole. As a golfer's arms and hands are obviously imparting a great deal of speed and force to the club and hence to the club head, most golfers find the wearing of bracelets, watches and similar articles on the arms or wrists to be inconvenient at best. In fact articles such as wristwatches may be damaged by such treatment, thus most golfers customarily remove such articles before beginning play.

As a result, when a golfer out on the course wishes to determine the time, he or she must return to their golf cart or bag to check their watch. Often, the cart or bag may be several yards or more from the location of the golfer and the ball, making such determination of time quite inconvenient.

The need arises for a tool or article for the repair of depressions in a golf green, which article may be conveniently carried by a golfer in a pocket in order to be readily at hand at all times. The article should also provide further utility in the form of a watch or timepiece secured thereto, thus providing a means for a golfer to conveniently determine the time at any point.

DESCRIPTION OF THE RELATED ART

U.S. Pat. No. Des. 253,420 issued to J.G. Heerlien on Nov. 13, 1979 discloses a Golfer's Tool. The shape of the article shows two prongs extending from a central portion, but no function is disclosed for the design.

U.S. Pat. No. Des. 307,619 issued to P.P. Koutroukides on May 1, 1990 discloses a Green Fork. The appearance is generally on the order of that of the Heerlien design above.

U.S. Pat. No. Des. 312,415 issued to B. Muller et al. on Nov. 27, 1990 discloses a Combined Watch And Clip. Each of the two prongs are formed of two parallel members joined by a rounded segment at the end, in the form of a clip.

U.S. Pat. No. Des. 318,625 issued to V.G. Stowell on Jul. 30, 1991 discloses a Divot Watch having an appearance on the order of the designs discussed above.

U.S. Pat. No. 4,960,239 issued to D.S. Wait on Oct. 2, 1990 discloses a Golf Tool And Carrier For Golf Items.

The device provides two prongs for the repair of minor damage to turf or golf greens, as well as providing for the carriage of two golf tees and a ball marker. A clip is provided so the device may be carried on a belt or the like, but the protrusion of the device when clipped to the outer clothing of a golfer might prove obtrusive. Moreover, an additional watch or timepiece must still be carried in order to provide a function approaching that of the present invention.

U.S. Pat. No. 4,960,278 issued to M.F. Hainey on Oct. 2, 1990 discloses a Golfer's Combined Divot Repair And Distance Measuring Device. The device provides for both of the above functions, which are related to use on a golf green or at least in relatively close proximity to the hole. No function is disclosed which is applicable to other aspects of the game, nor is any means of determining the time disclosed.

Finally, U.S. Pat. No. 5,022,650 issued to M.F. Madock on Jun. 11, 1991 discloses a Golf Tool including two prongs for turf or green repair in combination with a brush for cleaning club heads, cleats and other equipment. The disclosed device is of a relatively small size, which would appear to render the brush portion relatively ineffective. Moreover, while the prongs would be relatively easy to keep clean, it appears that the brush bristles would collect dirt and debris, thus lessening the desirability of carrying the device in a pocket, as in the case of the present invention. As above, no means of determining the time is provided by this device.

None of the above noted patents, either singly or in combination, are seen to disclose the specific arrangement of concepts disclosed by the present invention.

SUMMARY OF THE INVENTION

By the present invention, an improved tool for the repair of minor damage to golf greens is disclosed.

Accordingly, one of the objects of the present invention is to provide an improved tool for such repair which includes a watch or timepiece.

Another of the objects of the present invention is to provide an improved tool which includes means for carriage on a key chain or the like.

Yet another of the objects of the present invention is to provide an improved tool which includes means for the carriage of a ball marker or similar device.

Still another of the objects of the present invention is to provide an improved tool which may be basically formed of flat, planar material for ease and economy of manufacture.

A further object of the present invention is to provide an improved tool which also provides means for the adjustment of the timepiece and replacement of any battery which may be installed therein.

An additional object of the present invention is to provide an improved tool upon which the timepiece is easily and simply installed.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 4 is a rear elevational view showing further provision for the attachment of a key chain or the like.

Similar reference characters designate corresponding parts throughout the several figures of the drawings.

DESCRIPTION OF THE PREFERRED EMBODIMENT

Figure 1:
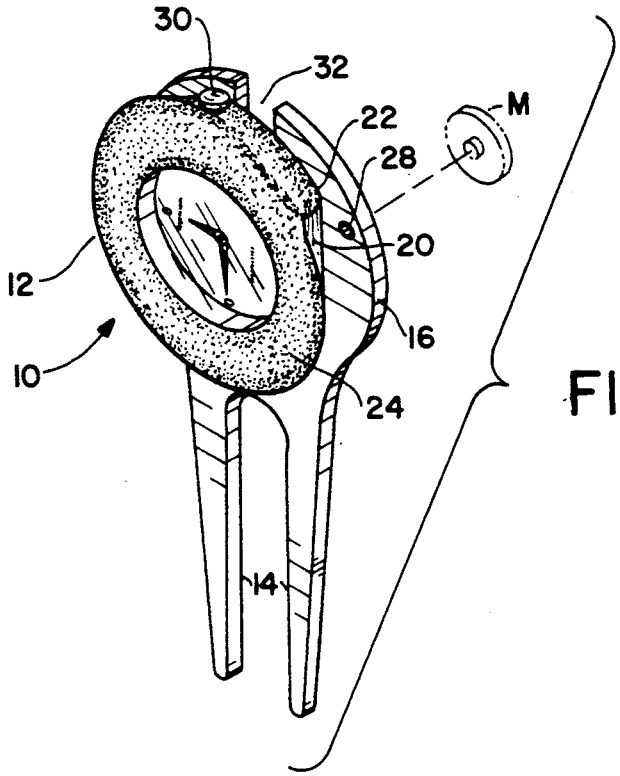
FIG. 1 is a perspective view of the combination green repair tool and timepiece of the present invention showing the basic configuration and provision for a ball marker.
Figure 2:
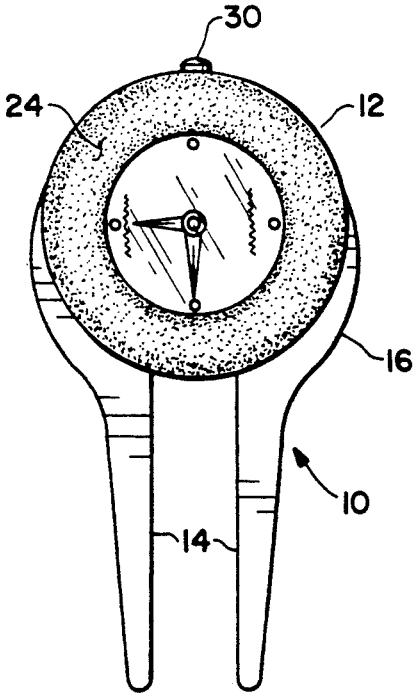
FIG. 2 is a front view of the tool of the present invention.
Figure 3:
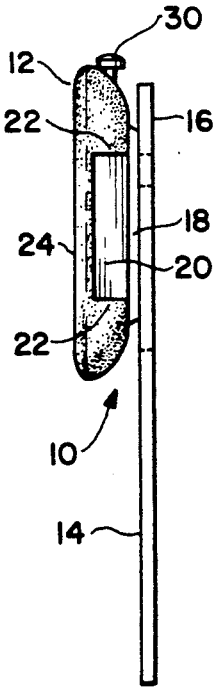
FIG. 3 is a side elevational view of the tool.
Figure 4:
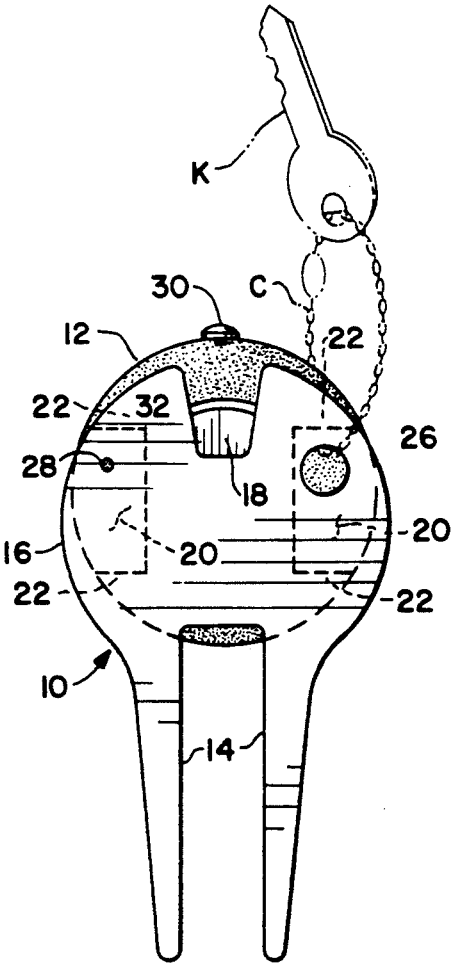

Referring now to the drawings, particularly FIG. 1 of the drawings, the present invention will be seen to relate to an improved tool 10 useful in the repair of relatively minor damage to golf greens and the like, in combination with a watch or timepiece 12 affixed thereto. Tool 10 will be seen to include two spaced apart and essentially parallel tine elements 14, extending from a base portion 16. Base portion 16 provides a mounting location for the securing of a watch or timepiece 12 thereto, as well as serving as a handle means for the use of tool 10 as a green repair tool. Base portion 16 and tines 14 are preferably formed or stamped of a single flat, planar sheet of material in the present embodiment, but may be formed in other shapes and of other material stock as desired.

The back 18 of timepiece 12 may be secured to base portion 16 of tool 10 by means of a hard setting permanent adhesive, such as an epoxy material or the like, or any other suitable adhesive, or alternatively timepiece 12 may be mechanically secured to base portion 16 of tool 10. By securing only the back portion 18 of timepiece 12 to base portion 16 of tool 10, the remainder of timepiece 12 may be separated from timepiece back 18 for access to the internal mechanism of timepiece 12 for repair, battery replacement, etc. in the manner known in the art for the maintenance and repair of such timepieces as electronic wristwatches and the like. In fact, the preferred embodiment of tool 10 includes such a wristwatch as a timepiece 12, in order to provide further advantages and features which will be discussed immediately below.

Wristwatches are generally provided with extensions to either side of the case, which extensions provide retaining means for the attachment pins for a wristband. The resulting inset 20 between extensions 22 of timepiece 12 of the present invention, may be used to advantage in the present invention by providing for the addition of other useful features.

Inset 20 of timepiece 12 as used to form the present invention, provides some additional amount of space between the overlying face portion 24 of timepiece 12 and the underlying base portion 16 of tool 10. Base portion 16 will be seen to include means for the attachment of a keychain C, the means comprising a keychain hole 26 underlying one of the inserts 20 to either side of timepiece 12. The space provided between the overlying face portion 24 of timepiece 12 and underlying portion of base portion 16, allows sufficient space for a keychain C to be installed through keychain hole 26 without the need for additional extensions of base portion 12 other than those required to form tines 14. Thus, base portion 16 of tool 10 may be formed so as to be closely congruent with the outer edge of the timepiece 12 used in combination to form the present invention, resulting in a relatively compact tool 10 which may be carried easily within a pocket if so desired. In a like manner, a ball marker retention hole 28 may be provided for the retention of a ball marker M. The extension of ball marker M may be inserted within marker retention hole 28 in order to retain such a ball marker M until needed.

It will be apparent that virtually any watch or timepiece will require setting from time to time, and the timepiece 12 provided as a component of the present invention will be seen to include a setting stem 30 extending from the case. Due to the adjacent position of base component 16 of tool 10, it might prove difficult for a person to grasp setting stem 30 for the adjustment of timepiece 12. Accordingly, a relief 32 is provided in the outer edge of base portion 16, adjacent to the overlying setting stem 30 of timepiece 12. Thus, a user of tool 10 may easily grasp setting stem 30 on either side due to the clearance provided by relief 32.

A golfer wishing to leave various personal articles behind while out on the course, may store such articles in a locker along with street clothing or shoes, etc. Tool 10 provides for the attachment of a locker key K by means of a keychain C or other suitable means. Thus, a golfer will only require a single key while out on the course, and that key K may be secured to tool 10 as described above and tool 10 carried in a pocket. Obviously, other keys or articles may be secured to tool 10 by means of keychain C and/or hole 26 as desired.

The golfer carrying tool 10 may use tool 10 for the minor repair of depressions in golf greens or the like, as discussed above, and be further provided with a watch or timepiece 12 to enable him or her to keep track of the time while out on the course. Thus, the user of tool 10 will have essential articles, such as a timepiece and locker key, with him or her in a light-weight and compact unit while out on the course, and may store other articles elsewhere without sacrificing the loss of convenience often incurred by not having a watch or timepiece readily available. While certain functions of tool 10, such as the repair tines 14 and ball marker retention means 28, are primarily directed to use on the greens, the timepiece 12 provided in combination with the remainder of tool 10 will be seen to be useful at virtually any point on the course.

It is to be understood that the present invention is not limited to the sole embodiment described above, but encompasses any and all embodiments within the scope of the following claims.

I claim:

1. A tool for use in the game of golf and providing a means of time determination and further means for the repair of minor depressions in the surface of golf greens and the like, said tool comprising in combination;

a base portion having two tines extending therefrom with said base portion and said tines formed of a single piece of planar sheet material, a timepiece, said base portion providing for the attachment of said timepiece thereto, said timepiece including a case having a a face and watch mechanism and having a back removable from said case with said back permanently secured to said base portion in a non-coplanar manner, whereby said tool is used for minor green repair and for the determination of time by a golfer during a game of golf.

2. The tool of claim 1 wherein;

said base portion comprises a shape similar to said timepiece.

3. The tool of claim 1 wherein;

said timepiece includes a pair of extensions to each side of said case with each said pair of extensions defining an inset included therebetween and underlying said face and further includes a setting stem extending from said case.

4. The tool of claim 3 wherein;

said base portion includes a passage providing for the attachment of a keychain therethrough, said keychain passage underlying one of said insets of said timepiece and spaced apart from said case of said timepiece by means of one said inset.

5. The tool of claim 3 wherein;

said base portion includes a passage providing for the retention of a ball marker, said ball marker passage underlying one of said insets of said timepiece and spaced apart from said case of said timepiece by means of one said inset.

6. The tool of claim 3 wherein;

said base portion includes means providing for the grasping of said setting stem of said timepiece, said means comprising a relief in said central portion adjacent ans spaced apart from said stem.

* * * * *